United States Patent [19]

Louison

[11] Patent Number: 4,551,995

[45] Date of Patent: Nov. 12, 1985

[54] REGULATING DEVICE FOR THE WARP AND THERMO-FIXING YARNS OF RIBBONS WITH SELF-GRIPPING LOOPS, CAPABLE OF BEING ADAPTED TO A KNITTING MACHINE

[75] Inventor: Guy Louison, Saint Bonnet les Oules, France

[73] Assignee: V. Louison et Cie, France

[21] Appl. No.: 544,084

[22] Filed: Oct. 21, 1983

[51] Int. Cl.[4] ..... D04B 23/00

[52] U.S. Cl. ..... 66/203; 66/132 R; 66/147; 139/291 R

[58] Field of Search ..... 66/147, 132 R, 152, 66/203; 139/291 R

[56] References Cited

U.S. PATENT DOCUMENTS

| | | | |
|---|---|---|---|
| 2,601,770 | 7/1952 | Goldsmith | 66/147 R |
| 3,530,687 | 9/1970 | Hamano | 66/147 X |
| 3,727,433 | 3/1973 | Hamano | 66/147 X |
| 3,767,749 | 10/1973 | Chiba | 139/291 R UX |
| 3,961,650 | 6/1976 | Marowsky | 139/291 R |
| 3,961,651 | 6/1976 | Balentine | 139/291 R |

*Primary Examiner*—Ronald Feldbaum
*Attorney, Agent, or Firm*—Eric P. Schellin

[57] ABSTRACT

A device for thermo-fixing tapes as they are taken up from the knitting machine.

9 Claims, 8 Drawing Figures

REGULATING DEVICE FOR THE WARP AND THERMO-FIXING YARNS OF RIBBONS WITH SELF-GRIPPING LOOPS, CAPABLE OF BEING ADAPTED TO A KNITTING MACHINE

This invention relates to a regulating device for the warp and thermo-fixing yarns of ribbons with self-gripping loops, capable of being adapted to a knitting machine.

It is well known that in the self-gripping or self-adhesive ribbons, one of the female ribbons is provided on at least one of the faces thereof with protruding and intermingled loops to be hooked in every plane with mushrooms or hooks made on a second male ribbon constituting the counter-part.

At the present time, the female ribbon is obtained by weaving or still by the knitting process which is advantageously preferred on account of the inexpensive production, and chiefly with a view to the possibility of holding and binding the bottom of each loop, this characteristic providing the permanent holding of each loop while preventing the deformation thereof during the repeated disengagements or hookings.

Nevertheless, the formation of the loops by knitting is somewhat faulty concerning the differences in the stretch of the warp yarns, resulting in an irregular formation and height, decreasing the efficiency of the hooking while impairing the appearance of the ribbon.

On the other hand, after the knitting of the loop ribbon on the machine, said ribbon has no steadiness whatever for the packing and the storing thereof, and is on the contrary twisted helically with interpenetration of the loops.

The invention has for its object, on the one hand a regulating device for the distribution and the permanent stretch of the loop yarns preparatory to their knitting in order to obtain regular knitted loops, and on the other hand a retractable thermo-fixing device providing at the outlet of the machine a stiffness and a steadiness of the ribbon, in order to facilitate the storing and chiefly the further operational steps to be performed on this ribbon, these devices being driven in synchronization with the speed of the knitting machine.

The object of the invention will be more clearly understood with reference to the attached drawings, however without being limited by the examples of said drawings, in which.

This arrangement for regulating the warp yarns and thermo-fixing the ribbons with self-gripping loops, intended for adaptation on a knitting machine, includes chiefly a creel (C) formed in the known manner of a frame supporting in superimposition the spindles for the accommodation of bobbins.

The upper row or rows of bobbins (B) permit the supply and the distribution of the weft yarns (T) the sheet of which arrives at the upper part of the knitting machine and is presented in the known manner through the intermediary of guide bars at right angles with the weft shifting device.

The intermediate rows of bobbins (Ca) permit the supply and the distribution of the chain yarns (D) intended for the formation of the ground of the ribbon. The sheet of chain yarns (D) travels through the intermediary of guide bars (1) and of reeds (2) on the driving rolls (3, 4 and 5) proper of the knitting machine, so that this sheet will be presented horizontally at right angles with the knitting device.

Figure 1:
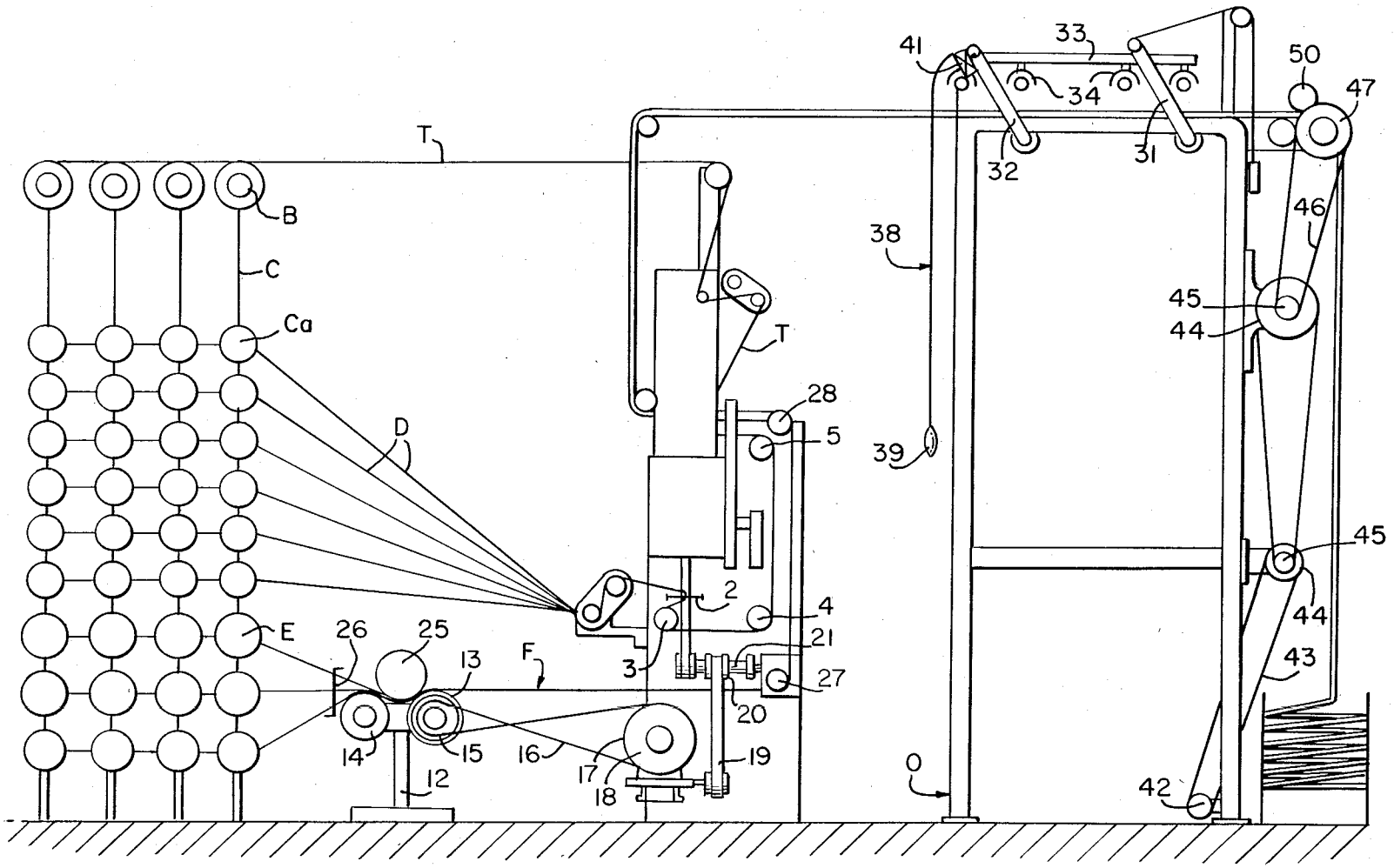
FIG. 1 is a schematic general and side view illustrating a knitting machine with a regulating device for the warp yarns and a thermo-fixing device, disposed and controlled on either side of a knitting machine.
Figure 2:
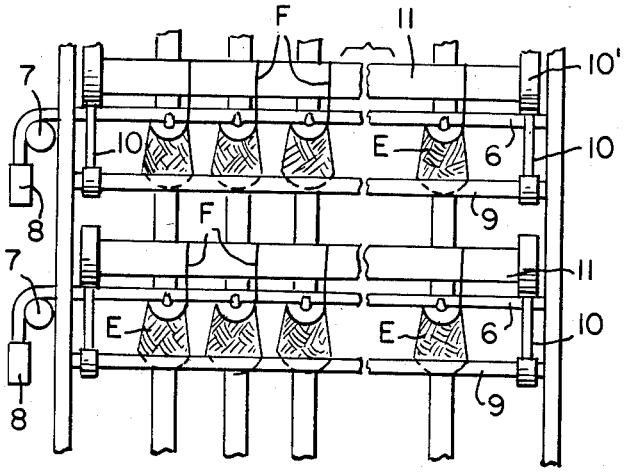
FIG. 2 is a partial longitudinal view on a larger scale illustrating the anti-twist controlled distributing device of the creel of the warp yarn reacher, to be used for the formation of the self-gripping loops of the ribbon.
Figure 3:
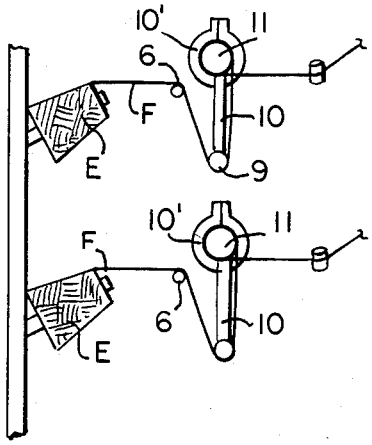
FIG. 3 is a cross-sectional side view corresponding to FIG. 2.
Figure 4:
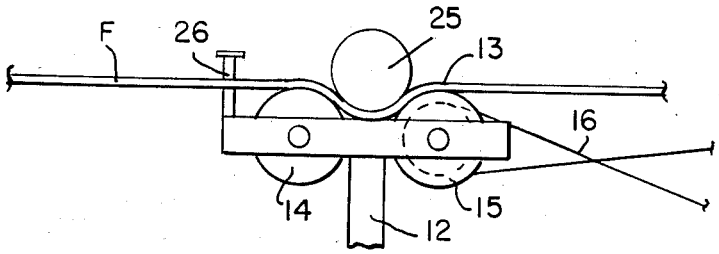
FIG. 4 is a partial side view illustrating the regulating and warp yarn reaching device to be used for the formation of the self-gripping loops of the ribbon.
Figure 5:
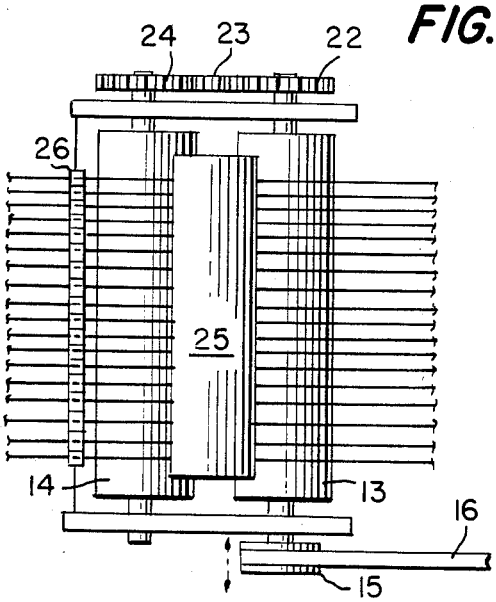
FIG. 5 is an external top view corresponding to FIG. 4.
Figure 6:
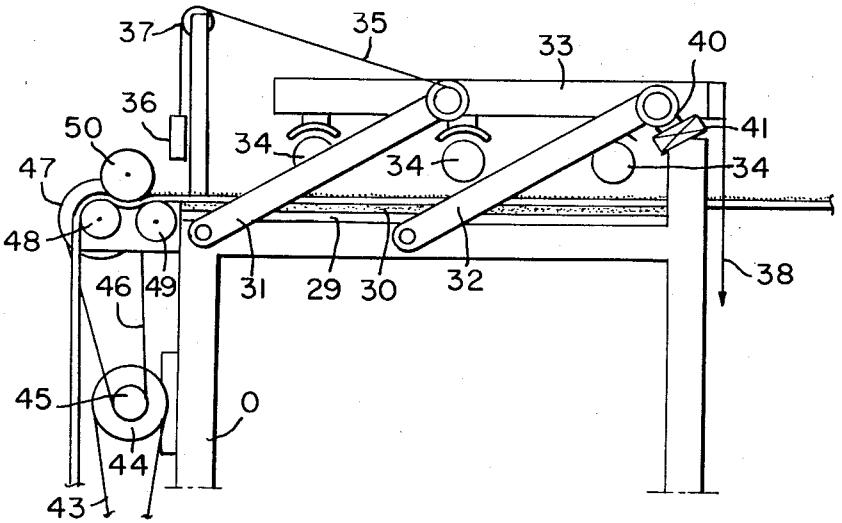
FIG. 6 is a partial transverse view on a larger scale of the thermo-fixing device which is acting on the ribbon after the finishing thereof, the dotted line illustrating the vertical disengagement of the heating tubes after the knitting machine has been stopped.
Figure 8:
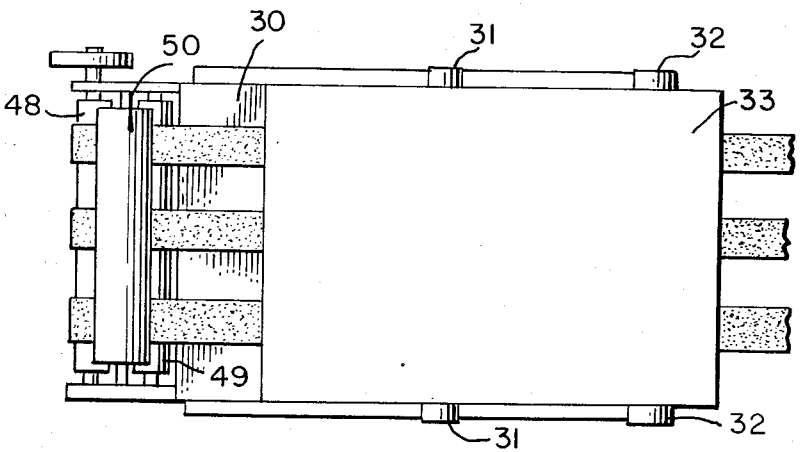
FIG. 8 is a top and plan view corresponding to FIG. 6.
Figure 7:
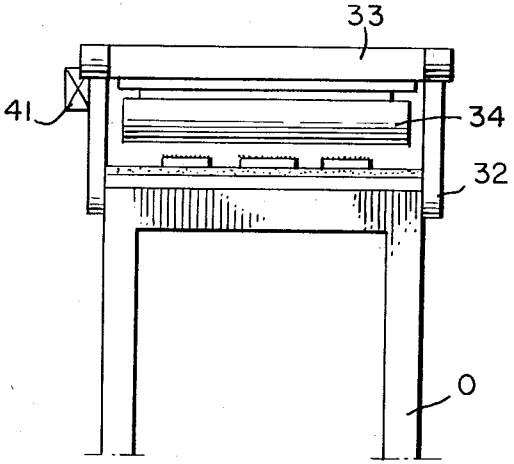
FIG. 7 is a front view of the device corresponding to FIG. 6.

The lower rows of bobbins (E) permit the supply and the distribution under control of the yarns (F) intended for the formation of the self-gripping female loops of the ribbon. This controlled distribution is provided by means of an anti-twist device which is mounted directly on the creel (C), and of a reacher device disposed at the end of the shrinking, which is driven directly for rotation in an adjustable manner by the knitting machine, In accordance with the invention, the anti-twist device is established, FIGS. 2 and 3, with a thread (6) disposed longitudinally between two superimposed rows of bobbins (E) and maintained in permanent stretch by means of a pulley (7) and of a counter-weight (8) secured to one of the ends thereof. This thread (6) permits the abutment and the guiding of the thread (F) along the axis of each bobbin (E) for untwisting the possible twists which could have been formed. Following the thread (6), each loop thread or yarn (F) travels downwardly to be wound up in part on an idler bar (9) which is moved circularly.

This bar (9) is mounted at the end of the arm (10) the upper ends of which form the clamping collars ($10^1$) for clamping a longitudinal fixed tube (11) around which the loop yarn (F) is also rolled up.

It is to be noted that the circular and concentric shifting by hand of the idler bar (9) relative to the tube (11) makes it possible to obtain a winding arc of a varying and adjustable magnitude and eliminating due to a corresponding friction the possible remaining twists. Further to the tube (11), the sheet of loop yarns (F) is shifted back transversely along each vertical row up to the reacher device.

The reacher device in accordance with the invention is disposed between the knitting machine and the creel (C) and has a footing in the form of two T-shaped supports (12) the upper legs of which permit therebetween the mounting of two rotary rollers (13 and 14) in juxtaposition. One of the rollers (13) receives externally on the projecting pin thereof a block pulley (15) with varying spacings between the blocks thereof in order to permit the winding with an adjustable diameter of a drive belt (16) engaged opposite with a drive pulley (17). The latter is mounted at the outlet of a speed reducing block (18) driven in turn by a belt (19) connected to a pulley (20) which is keyed up to the drive shaft (21) of the knitting machine. It will be clearly apparent, from the foregoing, that the roller (13) and therefore the sheet of loop yarns (F) are driven correctly by the drive shaft (21) within a pre-determined speed ratio.

On the opposite side, the roller (13) receives a toothed wheel (22) transmitting through an endless chain (23) the rotational motion to a gear (24) of the same diameter, which is keyed up to the end of the roller (14).

Consequently, the rollers (13 and 14) are rotated substantially at the same speed, in order to permit the distribution of the sheet of loop yarns (F) which is moved on these rollers and is maintained securely in abutment any slipping being prevented through the intermediary of a counter-roller (25) located by gravitation on and between said rollers. A reed (26) is moreover placed ahead of the roller (14).

In accordance with this arrangement, it will be seen that the rotational speed of the rollers (13 and 14), which is adequately adjustable by the spacing of the blocks of the pulley (15), is timed in dependence on the speed of the knitting machine. This characteristic makes it possible to obtain an appropriate and optimal distribution of the sheet of loop yarns (F) taking into account the height of the knitted loops as given by the lancets which are used.

Moreover, a regular and equal stretch along the whole width of the sheet of loop yarns (F) is provided by the arrangement of the rollers (13, 14) and of the counter-roller (25), in order to have an equal surface ready to be engaged with the knitting machine while providing the uniformity of the knitting in accordance with the right side and the back of the ribbon.

At the outlet of the reacher, the controlled sheet of the loop yarns (F) is moved through the intermediary of the drive rollers (27 and 28) inherent to the knitting machine, in order to be presented horizontally at right angles with the knitting device and above the sheet of chain yarns (D).

Knitting is effected in the known manner, however with a so-called "astraken" female ribbon provided with loops which are faultlessly uniform vertically and width, and which have a faultlessly homogeneous weave.

It is to be noted that the knitted ribbons are moved at the outlet of the knitting machine to the thermo-fixing device intended for imparting steadiness to them while stabilizing the loops vertically in order to eliminate the spiral effect making the storage impossible.

For this purpose, a framework (O) is disposed on the side opposite to the reacher, and forms at the upper part thereof a plate (29) provided with a fireproof plate (30) on which the ribbons delivered from the upper part of the knitting machines are unthreaded in abutment and by rows, and moved along by the regulating rollers proper of the framework.

The transverse sides of the framework (O) support at the upper part of the small connecting rods (31 and 32) journaled at the bottom thereof and connected hingedly at the opposite side to a horizontal frame (33) in order to constitute on either side a deformable parallelogramm permitting the vertical shifting of said frame (33) while maintaining substantially the horizontal positioning thereof.

Along the lower part thereof, the horizontal frame (33) permits the fastening of infra-red tubes (34) emitting radiations for thermo-fixing the ribbons only when the frame (33) has taken the lower operational position, and when the knitting machine is in operation.

It will be noted that the frame (33) is returned permanently in the upper clearance and non-interference position of the tubes (34) through the intermediary of a wire (35) hooked up at the rear of the frame (33) and stressed by a counter-weight (36) with an idler pulley (37) secured to an extension of the framework (O). On the opposite side, a further pull wire (38) with an actuating handle (39) provides the reverse return of the frame (33) for moving the tubes (34) adjacent to the ribbons so that the ribbons will be thermo-fixed.

This reverse return is limited by a shoe (40) integral with the upper extremity of a connecting rod (31 or 32), which cooperate in abutment with an electro magnet (41) jointly with the frame work (O). This electromagnet is connected on the electric circuit of the knitting machine to be excited continualy during the operation so that maintening the frame (33) in position of thermo-fixing adjacent to to the moving of the ribbons.

On the contrary, when the knitting machine is stopped, the electromagnet (41) will be switched off, and therefore the frame (33) will be suddenly returned upwardly due to the action of the counter-weight (36), eliminating thereby any thermo-fixing effect.

A drive motor (42) for the thermo-fixing device is also secured to the bottom of the framework (O) and is actuated electrically in synchronization with the electric circuit for the control of the knitting machine. This motor (42) is acting either by a belt (43) or upon a harness of speed reduction gears (44–45) transmitting the rotational motion by a second belt (46) to a wheel (47) secured to the end of a drive roller (48) mounted within the unthreading plane of the ribbons, this taking place however after the radiational step. A second roller (49) mounted for free rotation or possibly driven by the roller (48) at the same speed and at the same level permits in combination with said roller (48) the abutment of the ribbons after the treatment thereof, while a roller (50) located in superimposition and between the rollers (48 and 49) provides the guiding of the ribbons and the falling down thereof by gravitation into a container placed on the ground outside the framework (O).

It is important to point out that the driving speed of the ribbons, stabilized through the intermediary of the drive motor 42, is different from the speed of the regulating rollers of the knitting machine, taking into account the retraction effect of the length of the ribbons resulting from the thermo-fixing effect.

With this arrangement, it will be apparent that the operation of the knitting machine provides in combination: the driving control of the creel (C) through the intermediary of the pulley (15) which is acting upon the roller (13) at the appropriate speed, taking into account the height of the loops to be made, the electric switching in of the electromagnet (41) for maintaining in the lower position the frame (33) in order to perform the ribbon thermo-fixing step, the driving control of the roller (48) for the storage of the treated ribbons.

Should the knitting machine be stopped, the drive mechanisms for the creel (C) and the roller (48) will be also stopped, while the electromagnet (41) is not energized any more to permit the frame (33) to be cleared vertically due to the action of the counter-weight (36), and the thermo-fixing of the motionless ribbons is eliminated thereby.

The advantages will be clearly apparent from the description.

The invention is not limited in any way to the use nor to the form of embodiment of the various parts thereof which have been more particularly described, and any alternating form of embodiment remains within the scope of the invention.

I claim:

1. Regulating devices for the warp and thermo-fixing yarns of ribbons with self-gripping or self-adhesive loops, capable of being adapted to a knitting machine, characterized in that they include: a creel (C) with anti-twist means for the yarns (F) which are to form the self-gripping female loops of the ribbon; a reacher device for said yarns (F) with distributing rollers (13–14) driven with adjustable speed through the intermediary of a speed reduction gear (18) receiving its motion from the motor shaft (21) of the knitting machine; a thermo-fixing unit for the knitted ribbons at the exit thereof from the knitting machine, with a vertically movable horizontal frame (33) provided with the thermo-fixing elements and maintained in the lower working position by an electromagnet system (41) which is acting when the knitting machine is in operation only; a roller (48) with driving means for the ribbons after the stabilization treatment thereof, and driven at a controlled speed when the knitting machine is in operation.

2. Devices as claimed in claim 1, characterized in that the creel (C) is established with a frame supporting in superimposition the horizontal rows of spindles for accommodating the upper bobbins (B) for the supply and the distribution of the weft yarns T the sheet of which arrives directly to the knitting machine; with intermediate bobbins (C) for the supply and the distribution of the chain yarns (D) for the formation of the ground of the ribbons, the sheet of which is driven by the rollers proper of the knitting machine; and with lower bobbins (E) for the supply of yarns (F) for the formation of the female loops of the ribbons, with anti-twist means, the sheet of which arrives to the reacher device.

3. Creel as claimed in claim 2, characterized in that the anti-twist means for the yarns (F) for the formation of the female loops of the ribbons has a support-thread (6) which is stretched lengthwise between two rows of spindles for the abutment in superimposition of each yarn (F) and the downward vertical shifting thereof onto an idler bar (9) which is movable circularly around a fixed tube (11) the latter permitting the loop yarn (F) to be wound along an arc of varying magnitude in dependence on the circular positioning of the idler bar (9) by providing a corresponding friction, the sheet of loop yarns (F) being then towards the reacher device.

4. Devices as claimed in claim 1, characterized in that the reacher of the sheet of loop yarns (F) has a footing permitting at the upper part thereof the mounting of two drive rollers (13 and 14), one of the rollers (13) comprising at the end a drive pulley with blocks the spacings of which are varying for an adjustable speed given by a belt transmission from the motor shaft (21) of the knitting machine with an interposed speed reducing block (18), while the other roller (14) is directly driven by the roller (13) through the intermediary of a gear and chain transmission (23), a counter-roller (25) being disposed by gravitation upon the sheet of loop yarns (F) and between the rollers (13 and 14).

5. Devices as claimed in claim 1, characterized in that the thermo-fixing unit for the ribbons is provided with a framework (O) disposed opposite the reacher, with an abutment upper plate (29) for the knitted ribbons at the exit thereof from the knitting machine, and with a movable horizontal frame (33) mounted on small connection rods (31–32) as a deformable parallelogramm with heating means (34) acting by radiation on the said ribbons at the unthreading thereof on the plate (29), said thermo-fixing unit including also a retaining and disengaging means at the level of the frame (33) controlled by the shutting down of the knitting machine for eliminating the radiation effect and a driving means for the treated ribbon in order to permit the storage thereof.

6. Thermo-fixing unit as claimed in claim 5, characterized in that the retaining and abutting means for the frame (33) in the thermo-fixing position has an electromagnet (41) secured to the framework (O) for actuating a shoe (40) integral with a small connecting rod (31) during the magnetization, the energization of the electro-magnet (41) being provided permanently by the electric circuit for putting the knitting machine in operation.

7. A thermo-fixing unit as claimed in claim 6, characterized in that the frame (33) is returned in the remote upper position of the heating means (34) relative to the ribbons, when the electro-magnet (41) is not energized any more, through the intermediary of a counterweight (36) with idler pulley (37) secured to an extension of the framework (O), a pull wire (38) with actuating handle (39) permitting the reverse return of said frame (33).

8. The unit of claim 7, characterized in that the thermo-fixing unit for the ribbons is provided with drive rollers (48–49) disposed in juxta-position and with a counter-roller (50) located in abutment, said rollers being mounted in the unthreading plane of the ribbons after the radiation thereof in order to drive the ribbons away and to cause them to fall down into a storage receptacle.

9. The unit of claim 8, characterized in that the drive rollers (48–49) receive their motion from a motor (42) mounted on the electric circuit of the knitting machine in order to actuate a wheel (47) through the intermediary of speed reducing gears (44–45) and by belts (43–46), said wheel (47) being secured at the end of a drive roller (48), so as to provide a speed of the ribbons which differs from the speed of the regulating rollers of the knitting machine, taking into account the retraction effect due to the thermo-fixing treatment.

* * * * *